United States Patent [19]

Feldstein

[11] 4,274,550

[45] Jun. 23, 1981

[54] MEDICAMENT DISPENSING DEVICE

[75] Inventor: George Feldstein, Cresskill, N.J.

[73] Assignee: Myer B. Shimelman, Woodridge, Conn.

[21] Appl. No.: 36,567

[22] Filed: May 7, 1979

[51] Int. Cl.[3] ..... B65D 83/04; B65H 5/28

[52] U.S. Cl. ..... 221/71; 225/16

[58] Field of Search ..... 221/70–74, 221/15, 16, 2, 5, 7; 242/55.53; 225/10, 16; 206/530, 531, 534, 538, 539

[56] References Cited

U.S. PATENT DOCUMENTS

| | | | |
|---|---|---|---|
| 2,411,917 | 12/1946 | Wooster | 225/10 X |
| 3,395,829 | 8/1968 | Cogdell et al. | 221/70 X |
| 3,410,450 | 11/1968 | Fortenberry | 221/7 |
| 3,450,306 | 6/1969 | Gill | 206/534 X |
| 3,454,194 | 7/1969 | Becker | 221/71 |
| 3,762,601 | 10/1973 | McLaughlin | 221/2 |
| 3,917,045 | 11/1975 | Williams et al. | 221/71 X |

*Primary Examiner*—F. J. Bartuska

*Attorney, Agent, or Firm*—Bachman and LaPointe

[57] ABSTRACT

The present invention relates to a low cost throwaway medicament dispensing device characterized by structural integrity for dispensing a medicament to a user in a time controlled manner so as to discourage the taking of an overdose of the medicament by the user without interfering with the dispensing of a prescribed amount of the medicament.

7 Claims, 3 Drawing Figures

MEDICAMENT DISPENSING DEVICE

BACKGROUND OF THE INVENTION

The present invention relates to a medicament dispensing device and more particularly a medicament dispensing device having means for discouraging an individual from taking an overdose of said medicament.

All medicaments, whether over the counter medicaments such as aspirin or the like or prescribed medicaments such as barbiturates or the like, are capable of killing if abused and taken in overdose levels. Generally these medicaments are in the hands of stable individuals and therefore there is little fear of an overdose situation. However, even in these situations there is the chance that children, teenagers, unstable relatives, visitors or the like may get their hands on these medicaments with the result being a fatal accident.

A more dangerous situation arises when it is necessary for a physician to prescribe powerful medicaments to patients who are emotionally depressed and unstable. This is especially true in the area of psychiatry where the likelihood of the patient to take an overdose is greatly increased. As a result of this increased risk factor it behooves the physician and pharmacist, both from a moral and legal standpoint, to prescribe and dispose medicaments to such patients in a wise and cautious manner.

In addition to the foregoing, it would be desirous to dispense all medicaments, whether over the counter or prescribed, in a device which would discourage the taker from taking an overdose of the medicaments. In order to encourage drug manufacturers and packagers to dispense their medicaments in such a device it is necessary that the device be economical to manufacture and thereby add little to the overall cost of the medicaments. In addition to the cost factor, a further requirement is that the dispensing device have sufficient strength and integrity to discourage undesired entry thereof.

Accordingly, it is the principal object of the present invention to provide a medicament dispensing device having means for discouraging an individual from taking an overdose of the medicament.

It is a further object of the present invention to provide a throwaway medicament dispensing device which is inexpensive to manufacture.

It is a still further object of the present invention to provide a medicament dispensing device which is of sufficient strength and integrity so as to discourage undesired entry thereof.

Further objects and advantages of the present invention will be apparent from a consideration of the ensuing description.

SUMMARY OF THE INVENTION

In accordance with the present invention, it has been found that the foregoing objects and advantages may be readily obtained.

The present invention provides an inexpensive throwaway medicament dispensing device having means for discouraging an individual from taking an overdose of said medicament.

The $LD_{50}$, i.e., the lethal dose of a medicament which would result in the death of 50% of the population, for aspirin and other over the counter medicaments is in the neighborhood of seventy-five pills. The $LD_{50}$ for the most powerful prescribed barbiturates is in the neighborhood of twenty-five pills. Even in the case where a barbiturate is distributed in a 100 mg dose, which is not the norm, an $LD_{50}$ would be in excess of fifteen pills. The principles applied to the device of the present invention are designed to take advantage of the comparative large number of pills required to be taken before a lethal dose is achieved.

In accordance with the present invention, a medicament dispensing device is provided wherein the individual attempting to dispense said medicament is required to perform a significant amount of physical activity in order to dispense said medicament. As a result of the foregoing, there is automatically imposed a significant time lapse between the dispensing of a plurality of the medicament.

Statistically, the majority of suicide attempts are impulsive in nature and generally occur as a result of psychological frustration. The principles applied to the medicament dispensing device of the present invention allow sufficient time for reflection and reconsideration by the potential suicide victim before he is able to obtain a lethal dose. In addition, the suicide victim is required to exert himself thereby resulting in a degree of physical fatigue. At the same time, the medicament dispensing device of the present invention would not significantly interfere with an individual from taking his/her prescribed dose.

DETAILED DESCRIPTION

Figure 1:
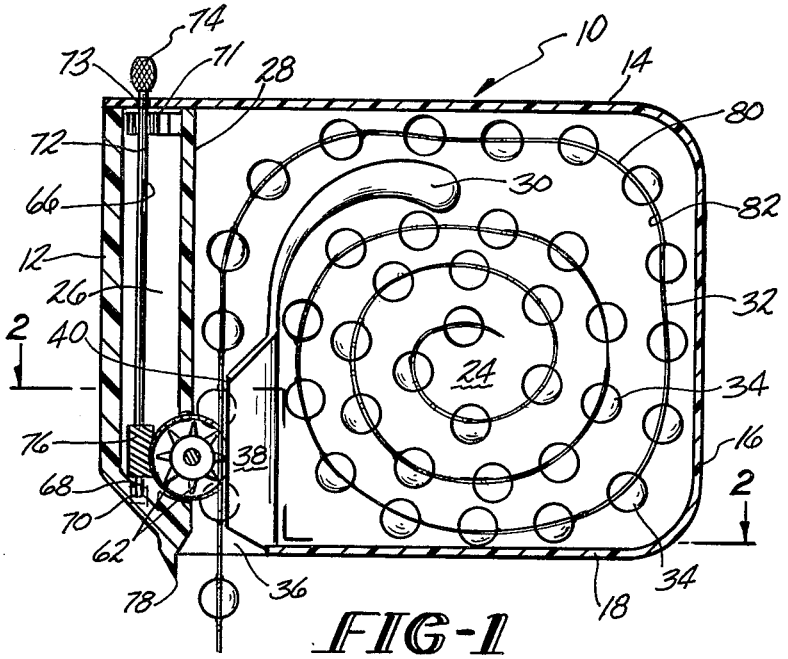
FIG. 1 is a cross sectional side view of a first embodiment of a medicament dispensing device in accordance with the present invention.
Figure 2:
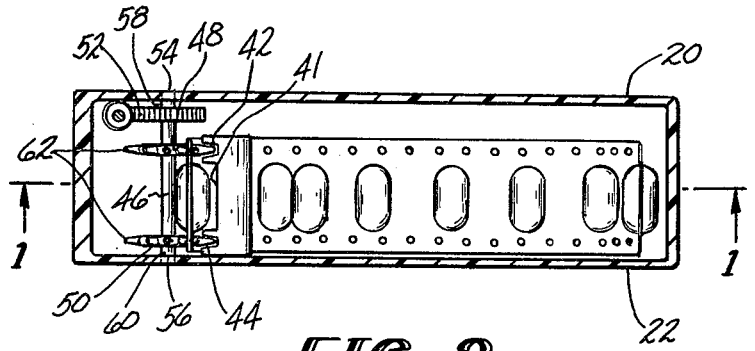
FIG. 2 is a cross sectional top view of the medicament dispensing device taken along line 2—2 of FIG. 1.

FIGS. 1 and 2 illustrate a first embodiment of the present invention wherein a substantially rectangular shaped medicament dispensing device 10 comprising four side walls 12, 14, 16 and 18, and top and bottom walls 20 and 22, respectively. The dispensing device is divided into a medicament compartment 24 and a drive compartment 26 by barrier wall 28. Provided in the medicament compartment 24 is a substantially "r" shaped guide wall 30 for guiding a medicament belt 32 enclosing medicament 34 from compartment 24 through an outlet opening 36 provided in side wall 18. As can best be seen with reference to FIGS. 1 and 2, "r" shaped guide wall 30 has an enlarged leg portion 38 which, on its back side 40, is provided with a recess 41 and a pair of grooves 42 and 44, respectively. With reference to FIG. 2, a shaft 46 having a pair of sprocket wheels 48 and 50 and a worm gear 52 fixedly mounted thereon is provided on either ends with integral studs 54 and 56 which are rotatably mounted in blind bore 58 and 60 provided in top and bottom walls 20 and 22, respectively. The sprocket wheels 48 and 50 each are provided with a plurality of teeth 62 which, upon rotation of shaft 46, pass through the grooves 42 and 44 provided on the backside 40 of leg portion 38 of "r" shaped guide wall 30.

Figure 3:
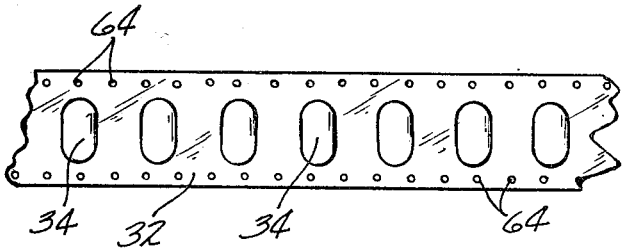
FIG. 3 is a perspective view of a pill belt employed in the medicament dispensing devices of the present invention.

With reference to FIGS. 1 through 3, medicament belt 32 along its entire length on either side of the medicament 34 is provided with a plurality of holes 64 adapted to receive the teeth 62 on sprocket wheels 48 and 50. Mounted for rotational movement in drive compartment 26 is drive shaft 66. One end 68 of shaft 66 is mounted in a blind bore 70 in the same manner as described above with regard to studs 54 and 56. The shaft 66 is mounted near the opposite end 72 thereof in a one way ratchet 71 which is mounted in drive compartment 26. The opposite end 72 of shaft 66 projects through an opening 73 in side wall 14 and is provided with an advance knob 74 integrally attached thereto. Fixedly located on shaft 66 proximate to end 68 is a worm 76 adapted to mesh with worm gear 52 and rotate same upon rotation of drive shaft 66. A relatively sharp cut edge 78 is provided on that portion of side wall 18 defining medicament outlet opening 36 for separating the medicament 34 from the rest of the medicament belt 32.

Referring to FIGS. 1 and 3 in the preferred embodiment of the present invention, medicament belt 32 comprises a plurality of plastic strips or the like 80 and 82 which are laminated together in a known manner such as heat or the like so as to encapsule the medicament 34.

The operation of the dispensing device of FIG. 1 will be made clear from the following description. Upon turning of the advance knob 74, worm 76 which meshes with worm gear 52 drives the sprocket wheels 48 and 50 such that the teeth 62 on the sprocket wheels 48 and 50 engage holes 64 on medicament belt 32 thereby moving the medicament belt 32 toward outlet 36 where the medicament 34 can be separated from belt 32 by cut edge 78. The use of a worm and worm gear drive connection acts as a lock and would prevent one from merely pulling the medicament belt out of the dispensing device.

In accordance with the principles of the present invention, it is required that the gear ratio between the worm and worm gear be such that a sufficient time lapse occurs before a lethal dose of medicament is dispensed so as to allow the potential suicide victim to reflect and reconsider his actions while at the same time produce a degree of physical fatigue. In addition, the time lapse should be such that the amount of physical work required to dispense a lethal dose of the medicament requires a conscious and concerted effort.

Expert opinion among doctors, particularly doctors in the field of psychiatry, reveals that, when combined with the above-noted physical work, a time lapse of from 1.0 to 5.0 minutes, preferably 2.0 minutes or more, would be sufficient to discourage a potential suicide victim from his/her fatal act. The strongest medicaments, i.e., barbiturates or the like, generally have an $LD_{50}$ in the neighborhood of twenty-five pills for the usual prescribed strengths. Medicaments which have an $LD_{50}$ of twenty pills are few while medicaments having an $LD_{50}$ of fifteen or less are virtually unheard of even when dispensed in 100 mg strengths which is more than the usual prescribed strengths which is in the neighborhood of 60 mg. Thus, if the drive mechanism is designed such that the time required to dispense each pill is from 4.0 to 12.0 seconds, preferably about 6.0 to 8.0 seconds, the desired time lapse is obtained even in the most unusual circumstances. When this time lapse is added to the time required to remove each medicament from its laminated packaging and the physical fatigue factor in dispensing the large quantity of medicament, it is assured that sufficient time would lapse to allow for reflection before a lethal dose could possibly be dispensed and taken by the potential suicide victim. Naturally, as the $LD_{50}$ increases so does the time lapse before a lethal dose is dispensed. At the same time, the time required to dispense a single medicament is not so lengthy so as to interfere with the everyday dispensing of the medicament.

With the above in mind, the ratio of worm to worm gear should be designed so as to allow for the above-noted desired time lapse and physical activity. It has been determined that if the aforenoted ratio is such that the advance knob must be rotated through 360° from 5 to 20 times, preferably not less than 10 times, the desired time lapse is obtained.

In order to encourage the use of the device of the present invention which is designed to be a throwaway item, it is necessary that it add little to the overall cost of the medicament. Furthermore, the unit must possess significant integrity against break ins. Suitable materials for use in the manufacture of the casing of the device include, preferably, plastics, particularly thermoplastic materials and metals, particularly aluminum. The medicament belt can be located in the casing and the same can be finally assembled into a unitary structure by ultrasonic welding or spot welding. A one way ratchet is provided in the drive mechanism of the instant invention so as to prohibit the user from rotating the advance mechanism in an improper direction thereby allowing disengagement between the sprocket wheels' teeth and the holes in the medicament belt.

It should be appreciated that the dispensing device discussed above may be modified so as to allow the local pharmacist to package medicaments himself. For example, top wall 20 may be pivotably mounted on front wall 12. A plurality of heat sealing tongues may be provided on the walls 14, 16 and 18 which project through a plurality of slits on wall 20 when the wall is pivoted to its closed position. Thus, the pharmacist may load the dispenser and, by applying heat to the tongues, seal the pivoted wall in place thereby providing a unitary structure which possesses the required integrity against break ins.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A low cost throwaway medicament dispensing device characterized by structural integrity for dispensing a medicament to a user in a time controlled manner so as to discourage the taking of an overdose of the medicament by the user without interfering with the dispensing of a prescribed amount of the medicament comprising:

housing means having a medicament disposed therein, said housing means comprising a unitary integral structure characterized by integrity against access to the interior thereof;

feed means interior of said housing means for feeding said medicament from said container to said user;

guide means interior of said housing for guiding said medicament, said guide means comprising a pair of grooves for receiving said feed means as said feed means feeds said medicament;

drive means exterior of said housing means for driving said feed means; and transmission means between said drive means and said feed means for feeding a lethal dose of said medicament to said user over a time frame of from about 1 to 5 minutes thereby allowing sufficient time to discourage the user from taking said lethal dose.

2. A medicament dispensing device according to claim 1 wherein said transmission means requires said user to perform substantial physical activity to dispense said lethal dose thereby further discouraging the user from taking said lethal dose.

3. A medicament dispensing device according to claim 2 wherein said medicament is encapsuled in a continuous belt thereby further discouraging the user from taking said lethal dose.

4. A medicament dispensing device according to claim 3 wherein said time lapse is not less than 2 minutes.

5. A medicament dispensing device according to claim 4 wherein said drive means comprises a rotating element and said transmission means requires said drive means to be rotated through 360° from about 5 to 20 times before said feed means feeds a single medicament.

6. A medicament dispensing device according to claim 4 wherein said drive means comprises a rotating element and said transmission means requires said drive means to be rotated through 360° not less than 10 times before said feed means feeds a single medicament.

7. A medicament dispensing device according to claim 1 wherein said guide means has a third groove larger than said pair of grooves through which said medicament passes as said feed means feeds said medicament.

* * * * *